United States Patent [19]

Shindo et al.

[11] 4,156,213

[45] May 22, 1979

[54] WIDE-BAND CIRCULAR POLARIZER

[75] Inventors: Shuichi Shindo, Yokosuka; Ryuichi Watanabe, Yokohama, both of Japan

[73] Assignee: Nippon Telegraph and Telephone Public Corporation, Tokyo, Japan

[21] Appl. No.: 827,638

[22] Filed: Aug. 25, 1977

[30] Foreign Application Priority Data

Aug. 30, 1976 [JP] Japan ..... 51-103392

[51] Int. Cl.[2] ..... H01P 1/16

[52] U.S. Cl. ..... 333/21 A; 333/35; 343/911 R

[58] Field of Search ..... 333/21 R, 21 A; 343/756, 909, 911 R; 356/112

[56] References Cited

U.S. PATENT DOCUMENTS 2,464,269 3/1949 Smith ..... 343/911 R

*Primary Examiner*—Paul L. Gensler

*Attorney, Agent, or Firm*—Sughrue, Rothwell, Mion, Zinn and Macpeak

[57] ABSTRACT

A plurality of dielectric plates are disposed side by side to form a dielectric plate assembly and matching layers are respectively disposed adjacent to both end faces of the dielectric plates. A plane wave is incident on one of the matching layers perpendicularly thereto and passes through the dielectric plate assembly and are emitted from the other matching layer. Ratios b/a and $a/\lambda_0$ (a being the distance between the centers of adjacent ones of the dielectric plates, b the thickness of each dielectric plate and $\lambda_0$ the free space wave length of the electric wave) are selected so that the frequency characteristics of the phase difference between the electric field components of the plane wave respectively perpendicular and parallel to the dielectric plates, which are produced by the passage of the plane wave through the dielectric plate assembly, has a value of 90° at two different values of $a/\lambda_0$.

4 Claims, 12 Drawing Figures

WIDE-BAND CIRCULAR POLARIZER

BACKGROUND OF THE INVENTION

This invention relates to a circular polarizer which is formed by arranging a plurality of dielectric plates side-by-side relation to provide an artificial anisotropic medium.

In the case where waveguide circuits heretofore employed for the millimeter wave band, such as a filter and the like, are utilized for frequency bands above 100 GHz, the circuit required therefor is very small and hence difficult to process and, further, the surface resistance of metal increases to cause an abrupt increase in the insertion loss. For use in such frequency bands, a filter utilizing a beam waveguide system has been studied. This kind of filter that has heretofore been proposed is one which employs a selective reflector, a circular polarizer and a Fabry-Perot resonator. The circular polarizer employed for this purpose is such that it is formed by disposing many dielectric plates side by side to present anisotropy equivalently, that is, to make the propagation constants of orthogonal electric field components different from each other. This kind of circular polarizer used in the waveguide is disclosed, for instance, in IRE Trans. Vol. MTT-5, No. 3 (July, 1957), pp. 199–203, Kroschbaum and Chen, "A Method of Producing Broad-Band Circular Polarization Employing an Anisotropic Dielectric", and a circular polarizer usable in the beam waveguide is set forth in U.S. Pat. No. 2,464,269 entitled "Method and Means for Controlling the Polarization of Radiant Energy" issued to Charles G. Smith on Mar. 15, 1949. In these prior art circular polarizers, the ratios b/a and $a/\lambda_0$ are selected to be sufficiently smaller than 1, a being the distance between the centers of adjacent ones of the dielectric plates, b the thickness of each dielectric plate and $\lambda_0$ the free space wave length of the plane wave used. As a result of this, the frequency characteristics of the phase difference between the electric field components that are perpendicular and parallel to the dielectric plates, respectively, undergo a linear change having a first-order inclination. Further, the frequency band in which the ratio between major and minor electric fields of the elliptically polarized output wave, this is, the so-called axial ratio, is less than 0.5 dB is only 6% or so in terms of the fractional band width. Accordingly, the bandwidth is narrow, so that when used as a filter, such circular polarizer cannot serve as a wide-band filter.

An object of this invention is to provide a circular polarizer having a wide frequency band.

Another object of this invention is to provide a wide-band circular polarizer that the frequency characteristics of the phase difference between perpendicular and parallel components present a value of 90° at two different values of $a/\lambda_0$.

Still another object of this invention is to provide a wide-band circular polarizer which can be formed small.

SUMMARY OF THE INVENTION

In accordance with this invention, many dielectric plates of substantially the same configuration and of the same thickness b are disposed side by side with the distance a held between adjacent ones of them to provide a dielectric plate assembly. The ratios b/a and $a\lambda_0$ are selected so that the frequency characteristics of the phase difference between electric field components of a plane wave respectively perpendicular and parallel to the dielectric plates, which are produced by the incidence of the plane wave on the dielectric plate assembly and the passage therethrough, have a value of 90° at two different values of $a/\lambda_0$, $\lambda_0$ being the free space wave length of the abovesaid plane wave. This enables the generation of circularly polarized waves over a wide band. Further, in order to reduce the insertion loss, matching layers are respectively provided forwardly and backwardly of the dielectric plate assembly in the direction of travel of the plane wave in opposing relation to the end faces of the dielectric plates. The equivalent dielectric constants of these matching layers are selected to be intermediate between the equivalent dielectric constant of the dielectric plate assembly and the dielectric constant of the free space. Thus, the plane wave passes through the dielectric plate assembly without being greatly reflected. The matching layers may be disposed in direct contact with the end faces of the dielectric plates, or coupling layers which are formed unitary with the dielectric plates to couple the free space. Further, the matching layers may be each formed with two layers. Moreover, letting the relative dielectric constant of the dielectric plate be represented by $\epsilon r$, $a/\lambda_0$ is selected to be smaller than $1/\sqrt{\epsilon r}$ so as to prevent the generation of a higher mode. With $b/a \geqq 0.6$ selected under this condition, the abovesaid frequency characteristics of the phase difference have the value of phase difference 90° twice within the range of $a/\lambda_0 < 1/\sqrt{\epsilon r}$. The ratio b/a is selected to be larger than 0.6, as mentioned above, but the relation $b/a \leqq 0.9$ is selected. That is, with $b/a > 0.9$, the frequency characteristics of the phase difference cannot have a 90° phase difference twice within the range of $a/\lambda_0 < 1/\sqrt{\epsilon r}$.

DESCRIPTION OF THE PREFERRED EMBODIMENTS

Figure 1:
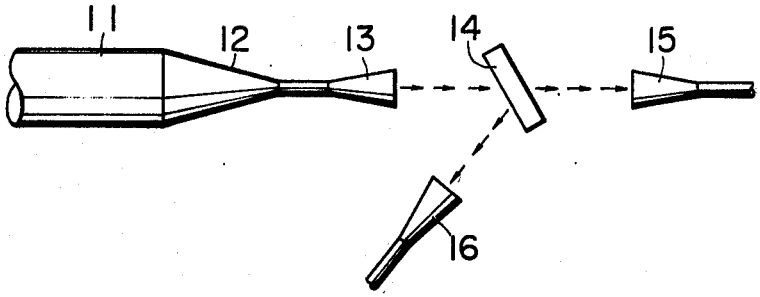
FIG. 1 is a schematic diagram showing a filter employing a beam waveguide.

Prior to a detailed description of the circular polarizer of this invention, a description will be given with regard to a beam waveguide filter, which is one of the applications of the circular polarizer. In FIG. 1, electromagnetic waves of frequencies $f_1$ to $f_n$, transmitted through a circular waveguide 11, are reduced in diameter by a tapered waveguide 12, and then projected onto a Fabry-Perot resonator 14 from a horn 13. The resonator 14 is resonant with one of the frequencies $f_1$ to $f_n$, for instance, $f_1$, so that the components of the frequency $f_1$ are picked up to be applied to a horn 15. The other frequency components are reflected from the resonator 14, and applied to another horn 16. In this manner, a filter utilizing the beam waveguide is formed.

Where a waveguide is used to form a filter for a high-frequency band above 100 GHz, the waveguide is small and difficult to process and the surface resistance of metal increases, which leads to an abrupt increase in insertion loss. However, the filter utilizing the beam waveguide, shown in FIG. 1, is free from such defects, and can be formed small as a whole, since its working frequency is high. In the filter depicted in FIG. 1, the resonator 14 is disposed obliquely to the propagation axes of the emanated waves from the horn 13, by which the reflected waves from the resonator 14 are separated from the incident waves thereto. With this filter, the propagation axis of the incident waves shifts due to its multiple reflection by the resonator to provide increased filtering loss. Similarly, the propagation axes of the waves reflected from the planes of incidence and emission of the resonator 14, respectively, are deviated from each other, resulting in an increased loss.

Figure 2:
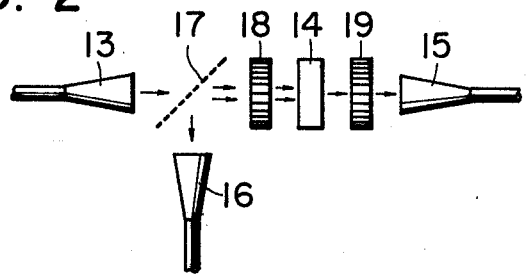
FIG. 2 is a schematic diagram showing a filter employing a circular polarizer.

To avoid the abovesaid defects, there has been proposed such an arrangement as shown in FIG. 2, in which the linearly polarized waves from the horn 13 pass through, for example, a metallic blind-like selective reflector 17, and enter a first circular polarizer 18. With the circular polarizer 18, the linearly polarized wave having passed therethrough is converted into a circularly polarized wave with a phase difference of 90° between two orthogonal electric field components, and this circularly polarized wave is supplied to the Fabry-Perot resonator 14. The resonator 14 permits the passage therethrough of the components of, for example, the frequency $f_1$ and the component of the frequency $f_1$ is applied to a second circular polarizer 19 in which the two orthogonal electric field components are phased 90° apart. Thus, the circularly polarized wave is reconverted into a linearly polarized wave, and then applied to the horn 15. On the other hand, the components of the frequencies $f_2$ to $f_n$, reflected from the resonator 14, return to the first circular polarizer 18, in which they are converted into linearly polarized waves and their electric fields are made orthogonal to those of the waves emanated from the horn 13, so that the linearly polarized waves are reflected from the selective reflector 17, and received by a horn 16. In this manner, the incident waves and the reflected waves are separated by the selective reflector 17 from each other and the resonator 14 can be disposed perpendicularly to the propagation axis, so that it is possible to obtain a filter of small loss without incurrence of the deviation of the propagation axis due to multiple reflection by the resonator 14 in FIG. 1.

Figure 3:
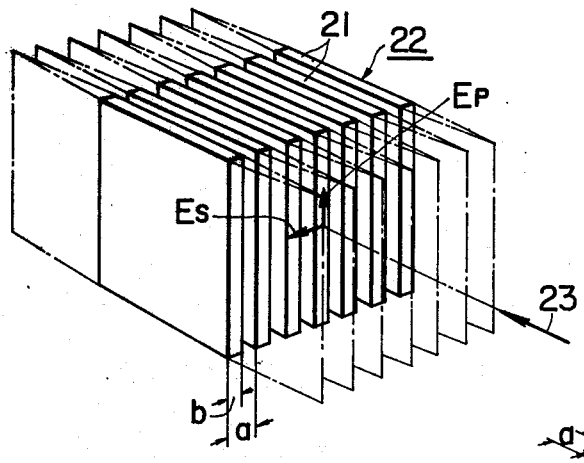
FIG. 3 PRIOR ART
FIG. 3 is a perspective view illustrating a conventional circular polarizer.

Each of the first and second circular polarizers 18 and 19 in FIG. 2 is such as shown in FIG. 3, in which square dielectric plates 21 of the same size are assembled together into a dielectric plate assembly 22. The dielectric plate assembly 22 is disposed so that a plane wave 23 may be incident thereon perpendicularly to one end face of each dielectric plate 21 and that the electric field E of its linearly polarized wave may have an angle of 45° to the dielectric plates 21. The components $E_s$ and $E_p$ of the electric field that are perpendicular and parallel to the dielectric plates 21, respectively, differ in their propagation constants from each other and the dielectric plate assembly 22 equivalently acts as an anistropic medium. Accordingly, if the both electric field components $E_s$ and $E_p$ are phased $\pi/2$ apart from each other, the incident linearly polarized wave is converted into a circularly polarized one. If the equivalent dielectric constant of the artificial medium of the dielectric plate assembly 22 is much different from the dielectric constant of the free space, the amount of the reflected waves increases, which is undesirable. To suppress this reflection, the ratio b/a has been selected to be smaller than unity in the past. Further, the spacing a has been selected to be sufficiently smaller than the free space wave length $\lambda_0$ of the plane wave 23 so that the respective parts of the dielectric plate assembly 22 may act uniformly, that is, serve as one substantially uniform anisotropic medium.

Figure 4:
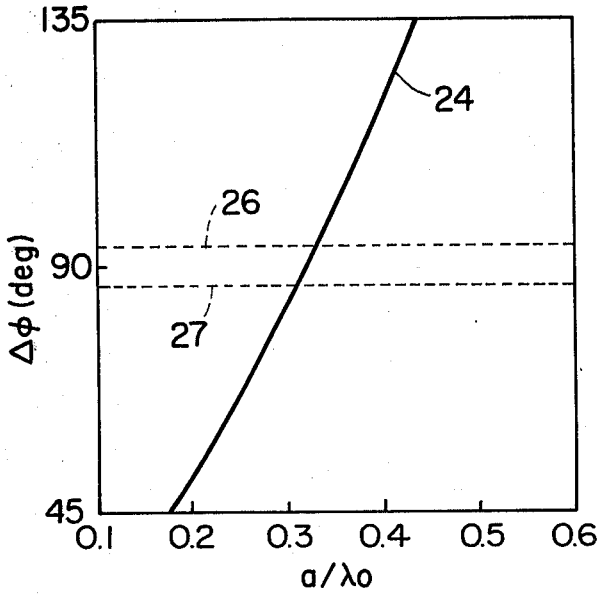
FIG. 4 PRIOR ART
FIG. 4 is a graph showing the frequency characteristics of the phase difference of the conventional circular polarizer.

The frequency characteristics of the phase difference $\Delta\phi$ between the perpendicular and parallel components $E_s$ and $E_p$ of the conventional circular polarizer with $b/a << 1$ and $a/\lambda_0 << 1$ present a linear variation having a first-order inclination as indicated by the curve 24 in FIG. 4. As is apparent from the graph of FIG. 4, the band in which the axial ratio of the output waves is less than 0.5 dB, i.e., the region between the curves 26 and 27 in FIG. 4, is only about 6% in terms of the fractional band width. In FIG. 4, the abscissa represents $a/\lambda_0$ and the ordinate the phase difference $\Delta\phi$, and there are shown the calculated values of the characteristics in the case where $b/a=0.2$ and the specific dielectric constant $\epsilon r$ of the dielectric plate 21 is 3.8.

In such a case as shown in FIG. 2 in which a plurality of filters are connected in cascade so that one of the frequency components $f_1$ to $f_n$ is separated first and then the other frequency components are similarly picked up one after another, a wide frequency band is required of the circular polarizer 18 employed as the filter at the first stage. Also, in the case of separating the incoming waves into components of two frequency bands, if the two frequency bands are broad, the frequency bands of the circular polarizers 18 and 19 are required to be broad. The conventional circular polarizer shown in FIG. 3 has too narrow a frequency band to realize such a filter. In the prior art, the ratio b/a is selected to be small so as to reduce the reflection. It is also possible to taper both ends of each dielectric plate 21 so that its thickness becomes gradually smaller along the propagation axes, as indicated by broken lines in FIG. 3. In this case, however, the propagation characteristic of the tapered portion varies along the propagation axis and the frequency band cannot be made broad, so that such configuration of the dielectric plate is not preferred. Further, it has the defect that the circular polarizer becomes bulky as a whole.

Figure 5:
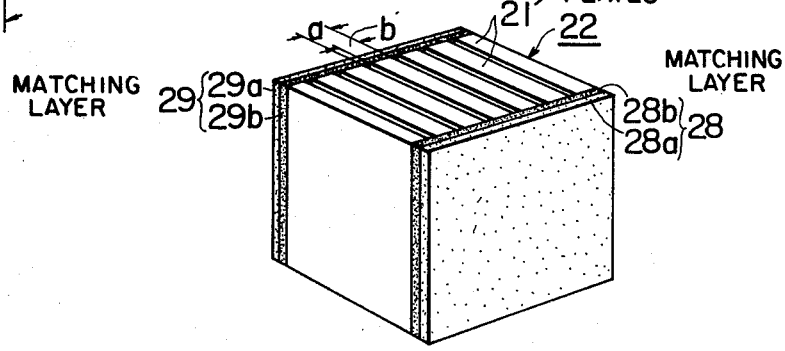
FIG. 5 is a perspective view illustrating an example of a wide-band circular polarizer according to this invention.

FIG. 5 illustrates an example of the circular polarizer of this invention. As is the case with the conventional circular polarizer depicted in FIG. 3, the dielectric plates 21 of the same size are assembled together so that they are disposed in predetermined spaced relation to adjacent ones of them, providing a dielectric plate assembly 22. With the present invention, the ratios b/a and $a/\lambda_0$ are respectively selected such that the frequency characteristic curve of the phase difference $\Delta\phi$ between the perpendicular and parallel components $E_s$ and $E_p$ of the electric field to each dielectric plate 21 takes a value of 90° at two different values of $a/\lambda_0$. From the viewpoint of preventing the characteristic deterioration by the generation of a higher mode, the ratio $a/\lambda_0$ is selected to be smaller than $1/\sqrt{\epsilon r}$, where $\epsilon r$ is the relative dielectric constant of the dielectric plate 21. Under this condition, the ratio b/a is selected to be in the range from 0.6 to 0.9, which is larger than that employed in the prior art. With the ratio b/a being smaller than 0.6, and being larger than 0.9, it is impossible to make the frequency characteristic curve pass the point of the phase difference 90° twice within the range of $a/\lambda_0 < 1/\sqrt{\epsilon r}$. Further, the ratio $a/\lambda_0$ must be selected to be smaller than $1/\sqrt{\epsilon r}$ but is preferred to be as close to $1/\sqrt{\epsilon r}$ as possible.

Figure 6:
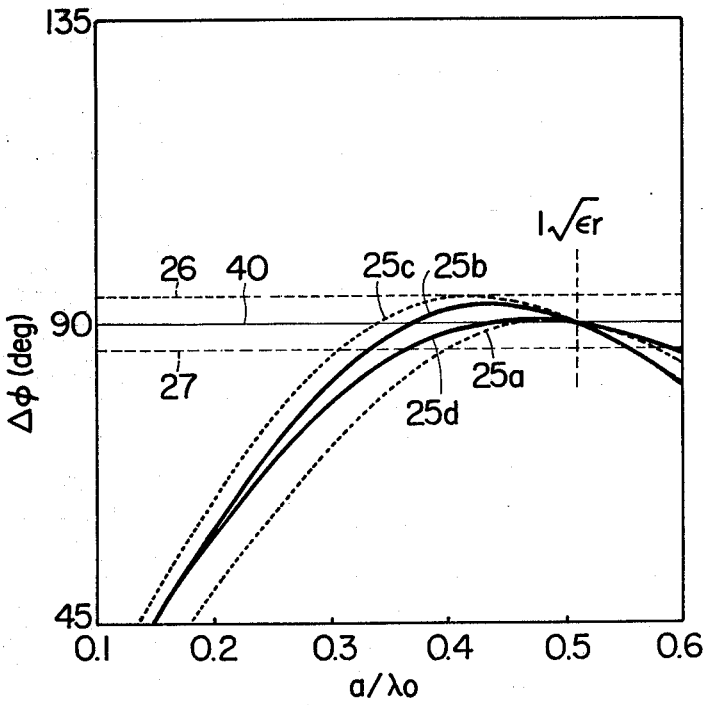
FIG. 6 is a graph showing the frequency characteristics of the phase difference of the circular polarizer exemplified in FIG. 5.
Figure 7:
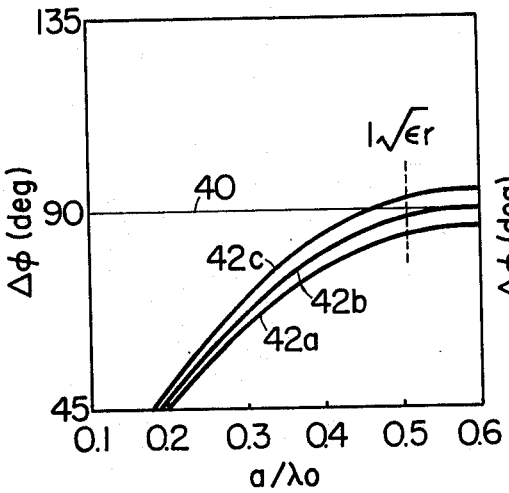
FIG. 7 is a graph showing the frequency characteristics of the phase difference in the case of the ratio b/a being 0.95.

The calculated values of the frequency characteristics of the phase difference $\Delta\phi$ between the perpendicular and parallel components $E_s$ and $E_p$ of the electric field in the case of $\epsilon r = 3.8$, are shown in FIG. 6 in which the ratio b/a is used as a parameter. In FIG. 6, the curves **25*a*, 25*b*, 25*c* and 25*d* indicate the cases of the ratio b/a being 0.6, 0.7, 0.8 and 0.9, respectively. Since the phase difference $\Delta\phi$ increases with the increase in the length of the dielectric plate 21 in the direction of the propagation axes, the curves 25*a* to 25*d* move in parallel along the ordinate depending upon the length of the dielectric plate 21 in the direction of the propagation axes. The peak value of the curve 25*d* in the case of b/a being 0.9 is substantially in contact with the line 40 of the phase difference 90° at the position where $a/\lambda_0$ is close to $1\sqrt{\epsilon r}$. If b/a exceeds 0.9, the dielectric plate assembly 22 is substantially entirely occupied by the dielectric plates 21: namely, the dielectric plates are scarcely spaced from adjacent ones of them, and its artificial anisotropy becomes smaller, so that when b/a is larger than 0.9, the frequency characteristic curve of the phase difference $\Delta\phi$ lies below the line 40 of the phase difference 90°. For instance, in the case where b/a is 0.95, the frequency characteristic curve does not come in contact with the line 40 of the phase difference 90°, as indicated by the curve 42*a* in FIG. 7. If the dielectric plate 21 is made longer in the direction of the propagation axes, the characteristic curves move up along the ordinate, as indicated by the curves 42*b* and 42*c* in FIG. 7, but these curves run across the line 40 of the phase difference 90°. For instance, in the case where b/a is 0.95, the frequency characteristic curve does not come in contact with the line 40 of the phase difference 90°, as indicated by the curve 42*a* in FIG. 7. If the dielectric plate 21 is made longer in the direction of the propagation axes, the characteristic curves move up along the ordinate, as indicated by the curves 42*b* and 42*c* in FIG. 7, but these curves run across the line 40** of the phase difference 90° only once within the range in which $a/\lambda_0$ is smaller than $1\sqrt{\epsilon r}$. Consequently, b/a must be selected to be smaller than 0.9.

Figure 8:
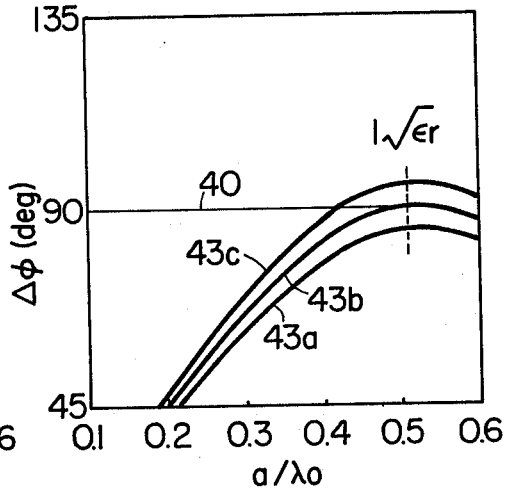
FIG. 8 is a graph showing the frequency characteristics of the phase difference in the case of the ratio b/a being 0.55.

Further, the peak of the curve **25*a* in the case of b/a being 0.6 is substantially in contact with the line 40 of the phase difference 90° at the position where $a/\lambda_0$ is close to $1/\sqrt{\epsilon r}$. Where b/a is 0.55, characteristics such as indicated by the curves 43*a* to 43*c* in FIG. 8 are resulted depending upon the length of the dielectric plate. In this case, since the peaks of the curves 43*a* to 43*c* lie at the position where $a/\lambda_0$ is larger than $1\sqrt{\epsilon r}$, the abovesaid curves cross the line 40** of the phase difference 90° only once under the condition $a/\lambda_0 < 1/\sqrt{\epsilon r}$ for preventing the higher mode generation. As will be seen from the above description, b/a is selected to be 0.6 to 0.9 in the range in which $a/\lambda_0$ is smaller than $1/\sqrt{\epsilon r}$.

As described above, with the circular polarizer of this invention, the frequency characteristic curve of the phase difference $\Delta\phi$ crosses the line 40 of the phase difference 90° twice to provide a remarkedly broad band as compared with the band obtainable with the conventional circular polarizer shown in FIG. 3. In the case of the curve 24 indicating the prior art, the band in which the axial ratio is smaller than 0.5 dB is 6% in terms of the fractional band width but, in the illustrated example, the abovesaid band accounts for 48% in the range of $a/\lambda_0 < 1/\sqrt{\epsilon r}$, and hence is very broad.

Figure 9:
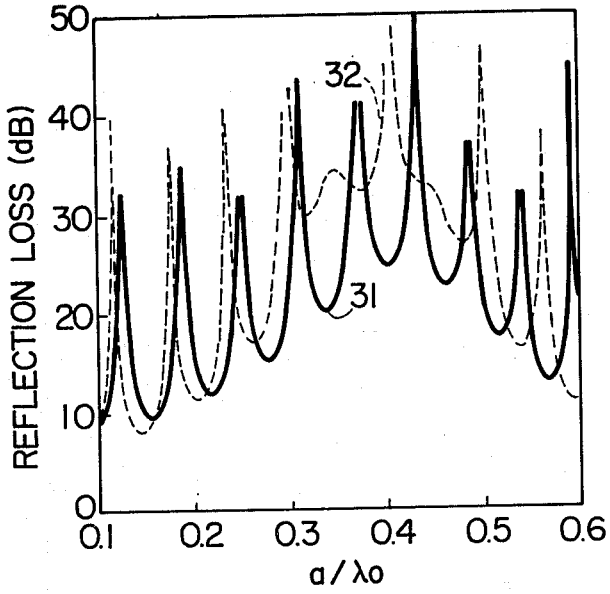
FIG. 9 is a graph showing the frequency characteristics of the reflection loss of the circular polarizer of this invention.

Thus, the ratio b/a is large, and consequently the dielectric plates 21 are each disposed in close proximity to adjacent ones of them, so that the dielectric constant of the artificial anisotropic medium of the dielectric plate assembly 22 becomes close to that of each dielectric plate 21 to increease reflection on the input and output planes of the dielectric plate assembly 22. Therefore, matching layers 28 and 29 are provided opposite to the input and output planes, respectively. The dielectric constant of each of the matching layers 28 and 29 is selected to be intermediate between the equivalent dielectric constant of the dielectric plate assembly 22 and the dielectric constant of the free space. In the example of FIG. 5, the matching layers 28 and 29 are composed of two layers **28*a* and 28*b*, 29*a* and 29*b*, respectively, so that the dielectric constants of the matching layers 28 and 29 may gradually vary. The matching layers, each composed of two dielectric layers, is based on the two-stage Chebyshev's impedance transformer and its principle is disclosed, for example, in Proceedings of The IRE, Feb. 1959, Vol. 53, pp 179–185, R. E. Collin, "Theory and Design of Wide-Band Multisection Quarter-Wave Transformers". In FIG. 9 there are shown the calculated values of reflection loss in the case where the relative dielectric constant $\epsilon r$ of the dielectric plate 21 is 3.8 and b/a=0.8 and the relative dielectric constanst $\epsilon_1$ and $\epsilon_2$ of the matching layers 28*a*, 28*b* and 29*a*, 29*b* are selected to be 1.3 and 2.3, respectively, in accordance with the abovesaid principle. In FIG. 9, the abscissa represents the ratio $a/\lambda_0$ and the ordinate the reflection loss, and the curve 31 is for the electric field component $E_s$ that is perpendicular to the dielectric plate 21 and the curve 32 is for the electric field component $E_p$ that is parallel to the dielectric plate 21**. From these curves, it is possible to obtain a circular polarizer that the frequecy band in which the reflection loss is above 20 dB is more than 50% and that the band of small insertion loss is wide. The relative dielectric constants $\epsilon_1 = 1.3$, $\epsilon_2 = 2.3$ and $\epsilon r = 3.8$ can be obtained with, for instance, foamed tetrafluoride resin (Teflon), polyethylene and quartz, respectively.

Figure 10:
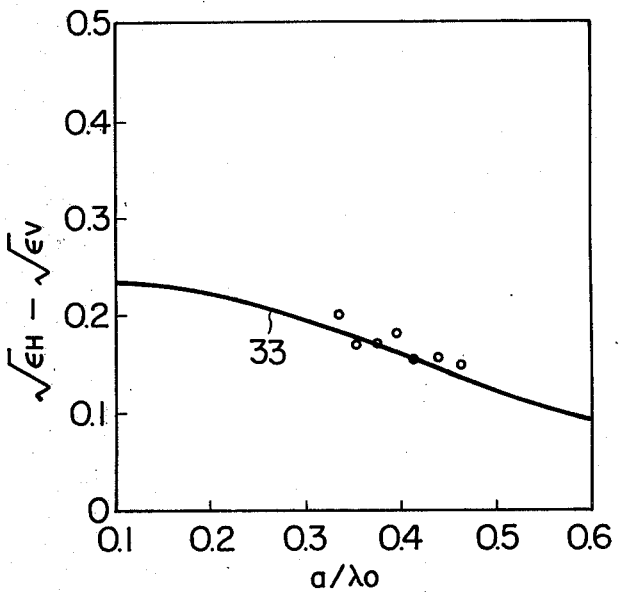
FIG. 10 is a graph showing the frequency characteristics of the propagation constant of the artificial anisotropic medium of a dielectric plate assembly employed in this invention.

Next, an experimental example of this invention will be described. Quartz plates of $\epsilon r = 3.8$ were used as the dielectric plates 21 and the ratio b/a was selected to be 0.8 and the difference in the propagation constant of the artificial anisotropic medium of the dielectric plate assembly 22, that is, the difference between the propagation constant $\sqrt{\epsilon s}$ of the plane wave that electric field component is perpendicular to the dielectric plates 21 and the propagation constant $\sqrt{\epsilon p}$ of the plane wave that electric field component is parallel to the dielectric plates 21, was measured in a band ranging from 80 to 110 GHz. The measured values are indicated by white circles and the calculated values are indicated by the curve 33 in FIG. 10, the abscissa representing the ratio $a/\lambda_0$. The measured values are a little larger than the calculated ones, but well agree with the latter. Since it has been ascertained that the insertion losses of the matching layers 28 and 29 shown in FIG. 5 well agree with the theoretical values, the use of such matching layers 28 and 29 enables realization of a circular polarizer which sufficiently suppresses the reflection and covers a wide band, as indicated by the calculated values in FIG. 10.

Figure 11:
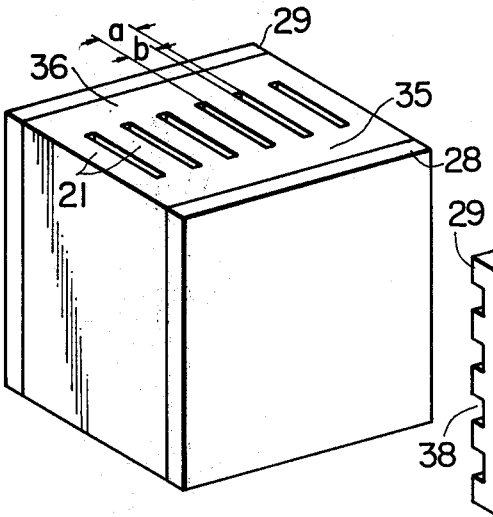
FIGS. 11 and 12 are perspective views respectively illustrating other examples of the circular polarizer of this invention.
Figure 12:
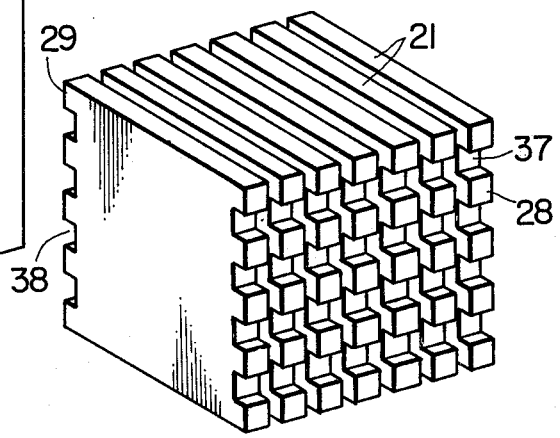

In the embodiment depicted in FIG. 5, the matching layers 28 and 29 are each comprised of two layers but may be single-layered in the case where the dielectric plates 21 have a small relative dielectric constant $\epsilon r$. Further, in the foregoing, the matching layers 28 and 29 are each coupled directly with the end faces of the dielectric plates 21 to hold them, too, but the dielectric plates 21 may also be coupled together at both end portions, respectively, with integral coupling layers 35 and 36 of the same quality, as illustrated in FIG. 11. In FIG. 11, the matching layers 28 and 29 are each formed with one dielectric layer and its thickness is selected to be a quarter wave length and its relative dielectric constant is selected to be $\sqrt{\epsilon r}$. Also, the matching layers 28 and 29 may be formed as shown in FIG. 12, in which a plurality of parallel grooves 37 and 38 are formed integrally in both end faces of dielectric plates 28 and 29 perpendicularly to the surfaces thereof at equal intervals so that the equivalent relative dielectric constants of the groove parts may be $\sqrt{\epsilon re}$ ($\epsilon re$ being the mean equivalent relative dielectric constant of the medium). Such a matching layer is set forth, for example, in Proc. IEE., 103C, pp. 153–158 (Sept. 1956), R. E. Collin and J. Brown, "The Design of Quarter Wave Matching Layers for Dielectric Surface".

As has been described in the foregoing, $b/a << 1$ and $a/\lambda_0 << 1/\sqrt{\epsilon r}$ has heretofore been employed based on the prior art knowledge but, in the present invention, by selecting $b/a$ and $a/\lambda_0$ to be close to 1 and $1/\sqrt{\epsilon r}$, respectively, it is possible to obtain the frequency characteristics that the phase difference $\Delta\phi$ presents a value 90° twice, enabling the realization of a wide-band circular polarizer. As a result of this, a wide-band filter for use in, for example, beam transmission, can be obtained.

It will be apparent that many modifications and variations may be effected without departing from the scope of the novel concepts of this invention.

What is claimed is:

1. A wide-band circular polarizer comprising:

a plurality of dielectric plates having substantially the same thickness b and disposed side by side at substantially the same center intervals a to form a dielectric plate assembly, $b/a$ and $a/\lambda_0$($\lambda_0$ being the free space wave length of a plane wave used ) being selected so that a frequency characteristic curve of the phase difference between electric field components of the plane wave, which are perpendicular and parallel to the dielectric plates, respectively, and which are produced by the passage of the plane wave through the dielectric plate assembly, takes a value of 90° at two different values of $a/\lambda_0$ , the plane wave being incident on one of the end faces of the dielectric plates perpendicularly thereto and being emitted at the opposite end faces of the dielectric plates; said characteristic curve being a plot of the phase difference against $a/\lambda_0$; and $b/a$ and $a/\lambda_0$ being in the ranges of $0.6 \leqq b/a \leqq 0.9$ and $a/\lambda_0$ being $\leqq 1/\sqrt{\epsilon_r}$, respectively, where $\epsilon_r$ is the relative dielectric constant of the dielectric plates; and matching layers disposed adjacent the opposite end faces in parallel relation to the plane wave incidence and emission planes of the dielectric plates, respectively, and having an equivalent dielectric constant between the equivalent dielectric constant of the dielectric plate assembly and the dielectric constant of the free space.

2. A wide-band circular polarizer according to claim 1, wherein the matching layers are respectively mounted directly on the end faces of the dielectric plates.

3. A wide-band circular polarizer according to claim 1, further including coupling layers, each coupling together the end faces of the dielectric plates on the same side and making contact with one of the matching layers.

4. A wide-band circular polarizer according to claim 1, wherein the matching layers are each multi-layered.

* * * * *